US005297571A

United States Patent [19]

Chu et al.

[11] Patent Number: 5,297,571

[45] Date of Patent: Mar. 29, 1994

[54] TWO BUTTON SAFETY UMBRELLA

[76] Inventors: Chin-Tang Chu, No. 18, Lane 49, Chung Shau Road; Wen-Ching Haong, 4F, No. 1, Lane 213, Min Hu Road, both of Hsinchu, Taiwan

[21] Appl. No.: 948,306

[22] Filed: Sep. 22, 1992

[51] Int. Cl.[5] ..... A45B 25/14; A45B 25/16

[52] U.S. Cl. ..... 135/24

[58] Field of Search ..... 135/22, 24

[56] References Cited

U.S. PATENT DOCUMENTS 3,658,077 4/1972 Sato ..... 135/22
4,421,133 12/1983 Huang ..... 135/22
4,534,374 8/1985 Day ..... 135/22
4,825,888 5/1989 Su ..... 135/22

*Primary Examiner*—Carl D. Friedman
*Assistant Examiner*—Kevin D. Wilkens
*Attorney, Agent, or Firm*—Morton J. Rosenberg; David I. Klein

[57] ABSTRACT

A two button safety umbrella is provided having an inner tube, a middle tube, and an outer tube, which are respectively coupled to related ribs of the umbrella. A coil spring is disposed within the inner tube and the middle tube is disposed over the inner tube. Two button assemblies are coupled to the middle and the outer tubes, respectively, to control the opening and closing of the umbrella, which is thereby operated easily and safely.

1 Claim, 4 Drawing Sheets

TWO BUTTON SAFETY UMBRELLA

BACKGROUND OF THE INVENTION

In prior systems, an umbrella which can be automatically opened and closed includes at least two coil springs in its shaft. One spring is compressed and the other is in tension. When a user is going to open or to close the umbrella, he must use enough force to overcome the total force of two springs, changing the state of both springs. Such an umbrella can be easily operated by a normal man, however, if the user is a woman or a child, they would obviously find it hard to operate this type of umbrella.

SUMMARY OF THE INVENTION

It is an object of the present invention to mitigate and/or obviate the above-mentioned drawbacks of prior art umbrellas in the manner set forth in the Description of the Preferred Embodiment.

A primary object of the present invention is to provide an umbrella including a slidable shaft assembly to make the opening and closing of the umbrella easier.

Another object of the present invention is to provide an umbrella having two buttons, which can be operated to open or close safely by a respective button.

Further objects and advantages of the present invention will become apparent as the following description proceeds, and the features and novelty are characterized in the claims annexed to and forming a part of this invention.

DESCRIPTION OF THE PREFERRED EMBODIMENT

Figure 1:
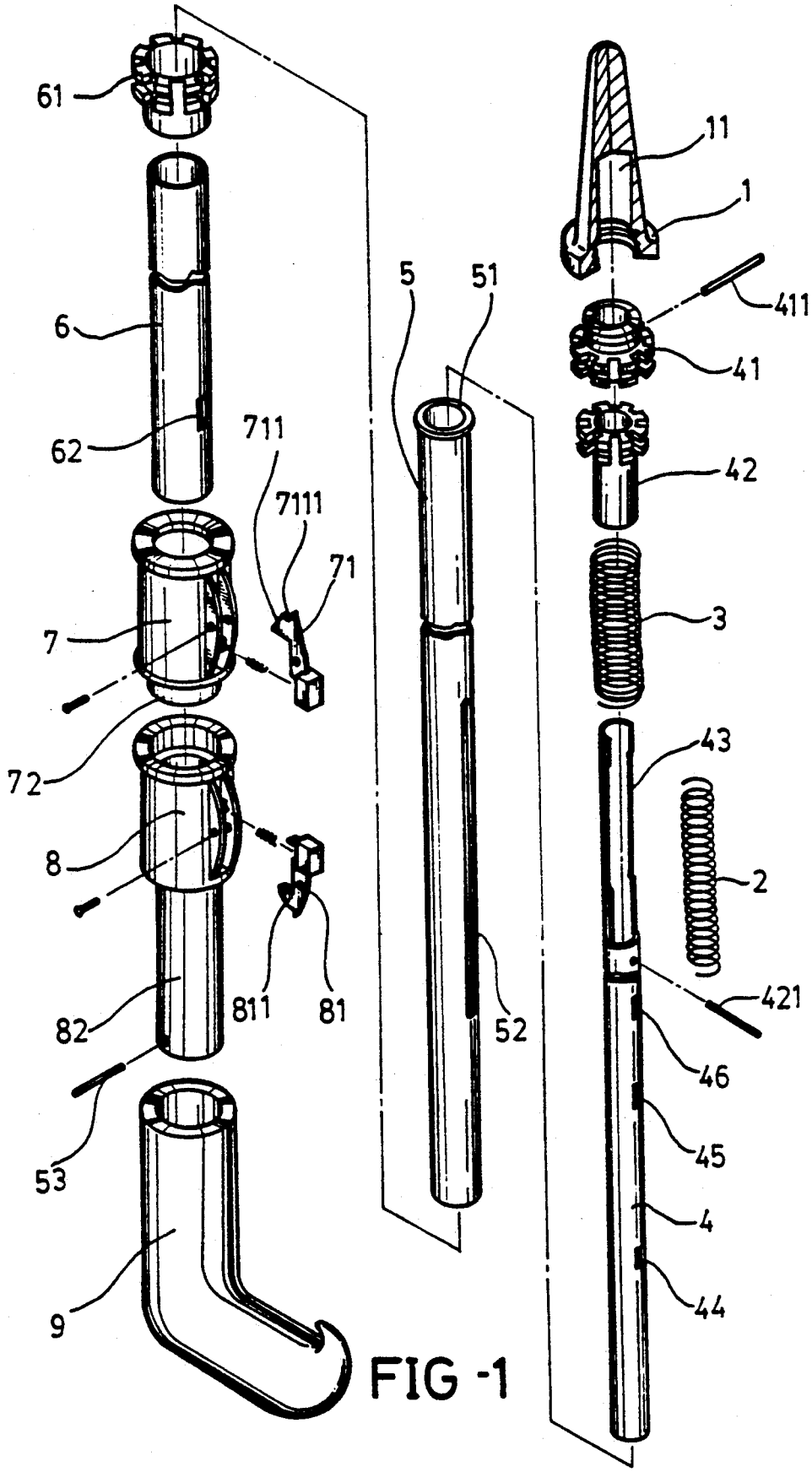
FIG. 1 is a perspective exploded view of an umbrella in accordance with the present invention.
Figure 2:
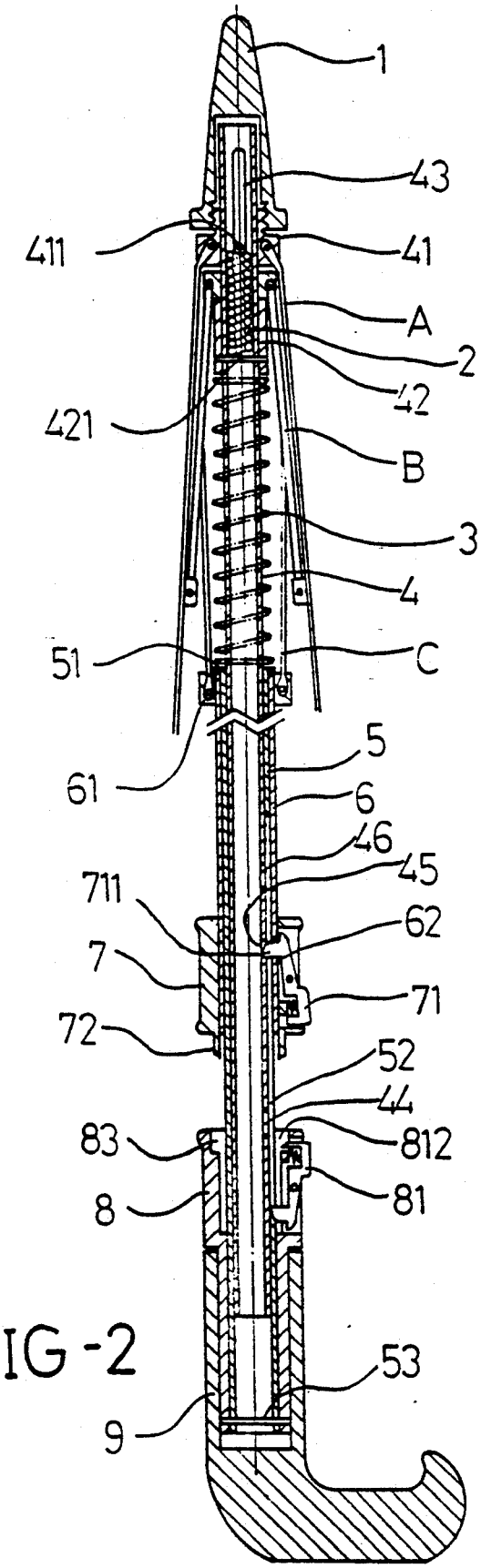
FIG. 2 is a cross-sectional view showing the umbrella in a closed state according to the present invention.

Referring to FIGS. 1 and 2, the present invention includes a cap 1, an upper coil spring 2, a lower coil spring 3, an inner tube 4, a middle tube 5, an outer tube 6, an upper button assembly 7, a lower button assembly 8, and a handle 9. A first crown 41 is slidably connected to the inner tube 4 by a pin 411 passing through a pair of grooves 43 formed on opposing sides of the inner tube 4. A second crown 42 is fixed by a pin 421 at the upper portion of the inner tube 4. The cap 1 is threadedly coupled to the upper crown 41, and has a cavity formed therein for receiving the top end of the inner tube 4. The upper coil spring 2 is disposed in the inner tube 4 between the pins 411 and 421. The lower portion of the inner tube 4 is provided with three holes 46, 45, and 44, whose function will be described in following paragraphs. The middle or intermediate tube 5 is concentrically disposed over the inner tube 4 and has an upper flange 51 and a longitudinally extended slotted opening 52 which aligns with the holes 46, 45 and 44 of the inner tube 4. The lower end of the middle tube 5 is secured to the lower button assembly 8 and handle 9 by a pin 53. The lower coil spring 3 is disposed around the inner tube 4 between the second crown 42 and the flange 51 of the middle tube 5. The outer tube 6 is concentrically disposed outside the middle tube 5 and is coupled to a third crown 61 at its top end. A side hole 62 is formed on the outer tube 6 and aligns with the longitudinal slotted opening 52 of the middle tube 5. The upper button assembly 7 is positioned outside the outer tube 6 and includes a stopper 71 with a hook 711 and an inclined face 7111. The lower end portion 72 of the upper button assembly 7 has a smaller diameter than the upper portion of button assembly 7. The lower button assembly 8 is also positioned outside the outer tube 6, and has its lower end fixed to the handle 9 by the pin 53. The top end of the lower button assembly 8 has a receiving portion 83 formed therein to receive the lower end 72 of the upper button assembly 7. A second stopper 81 with a hook 811 and a protrusion 812 is connected into the button assembly 8.

The first crown 41 is pivotally coupled to the inner end of each of the ribs A, and the second crown 41 is pivotally coupled to the inner end of each of the ribs B. The outer end of each rib B is pivotally connected to a middle position of a respective rib A. The third crown 61 is pivotally coupled to the inner end of each of the ribs C. The outer end of each rib C is pivotally coupled to a middle position of a respective rib B.

FIG. 2 shows the umbrella in a stably closed state, the upper coil spring 2 being compressed and the lower coil spring 3 being relaxed. The pin 411 is at the lowest position within the groove 43. In this position, the hook 711 of the first stopper 71 is inserted into the hole 62, groove 52, and the hole 45. The hook 811 is inserted into the groove 52 and contacts the surface of the inner tube 4.

Figure 3:
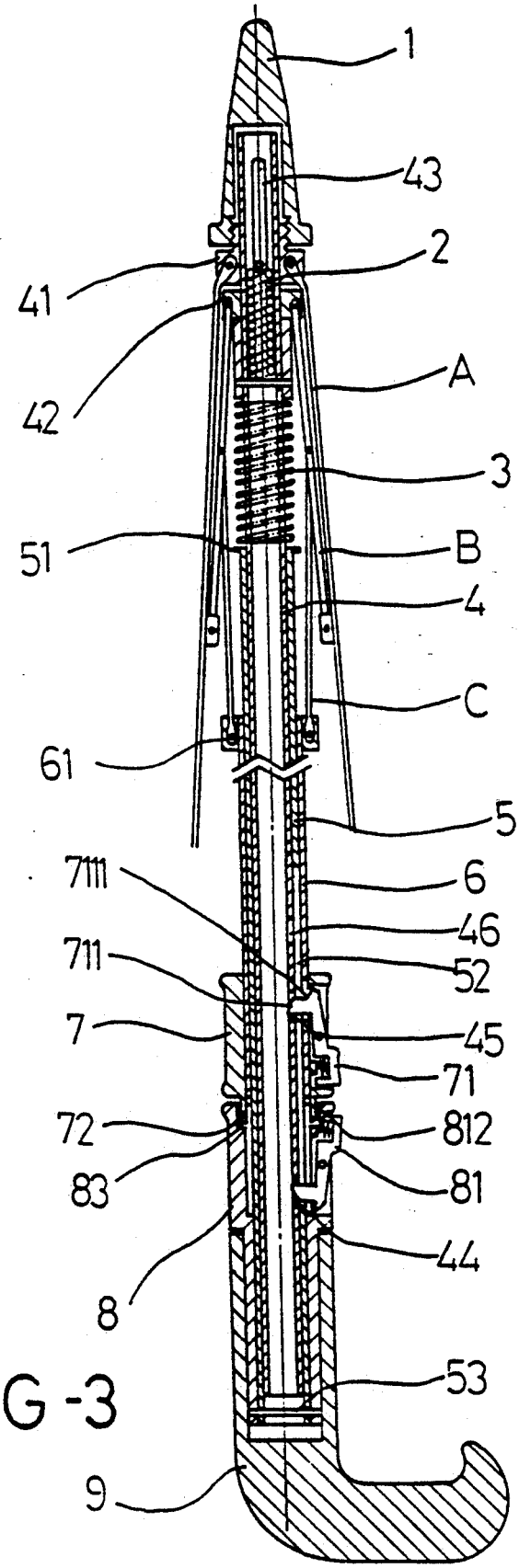
FIG. 3 is a cross-sectional view showing the umbrella being compressed and ready for opening according to the present invention; and, FIG. 4 is a cross-sectional view showing the umbrella in an opened state according to the present invention.

It is known that before using an automatically opened and closed umbrella, the user must input a force to the umbrella. Referring to FIGS. 3, such shows that the umbrella has had a force input to compress the lower coil spring 3. The user can easily input such a force, by putting the cap 1 of the umbrella in contact with the ground or a wall and pressing the handle. At that moment, the umbrella is slightly shortened, the lower button assembly 8 is displaced to position the receiver 83 around the lower end 72 of the upper button assembly 7, while the hook 811 of the second stopper 81 is inserted into the hole 44 of the inner tube 4 for engagement therewith and the lower coil spring 3 is thereby compressed. Because the protrusion 812 of the second stopper 81 is adjacent the lower end 72 of the upper button assembly 7, the second stopper 81 is unable to be pushed, for safety.

Figure 4:
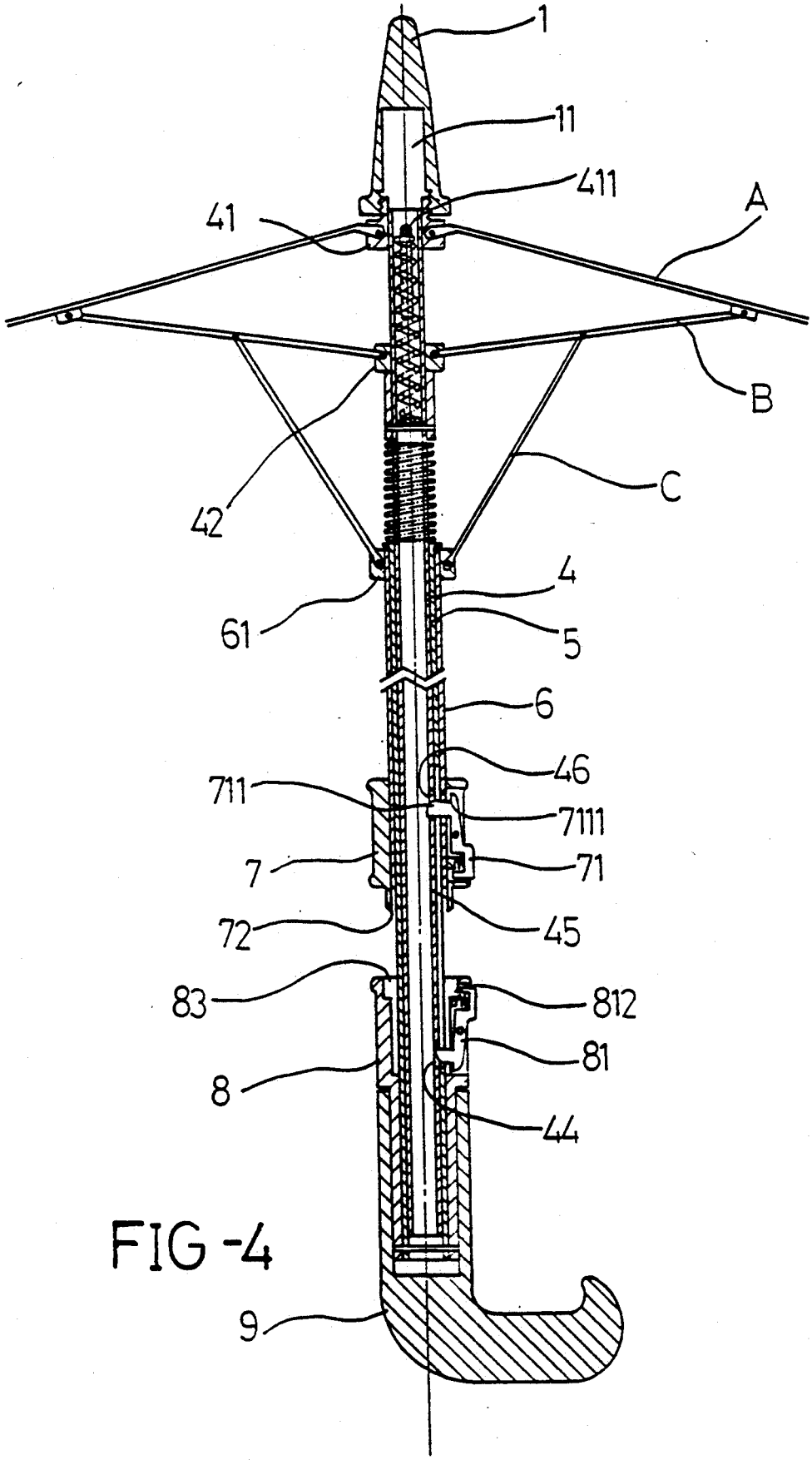

When the user pushes the stopper 71, the hook 711 will be displaced from the hole 45 of the inner tube 4, the upper coil spring 2 is released and the ribs are expanded outward to open the umbrella, while the outer tube 6 can be moved upward at the same time, as shown in FIG. 4. The hook 711 is engaged in the hole 46 of the inner tube 4 and the hook 81 is engaged in the hole 44 of the inner tube 4 when the umbrella is opened.

To close the umbrella, the user can push the top portion of stopper 81. Since the protrusion 812 is no longer limited by the lower end 72 of the upper button assembly, the stopper 81 can be operated to displace the hook 811 from the hole 44 of the inner tube 4. The lower coil spring 3 is then released and the inner tube 4 is forced to move upward to close the umbrella and compress the upper coil spring, as shown in FIG. 2. When the outer tube 6 moves downward, the lower end contacts the inclined face 7111 of the hook 71, the downward force will cause the hook 7 to move outward and be displaced from the hole 46 of the inner tube 4. The inner tube 4 then moves upward again until the umbrella is completely closed.

I claim:

1. A two button safety umbrella, comprising:

a longitudinally extended inner tube member having upper and lower portions;

an intermediate tube member concentrically disposed on said inner tube member, said inner tube member being slidable within said intermediate tube member, said intermediate tube member having a flange formed on one end thereof and being fixedly coupled to a handle member on an opposing end;

an outer tube member concentrically disposed on said intermediate tube member and slidable thereon;

a first crown member slidably coupled to said upper portion of said inner tube member;

a plurality of first rib members, each of said plurality of first rib members having one end pivotally coupled to said first crown member;

a second crown member fixedly coupled to said upper portion of said inner tube member below said first crown member;

a plurality of second rib members, each of said plurality of second rib members having one end pivotally coupled to said second crown member and an opposing end pivotally coupled to an intermediate portion of a respective one of said plurality of first rib members;

an upper coil spring member disposed within said inner tube member between said first and second crown members for applying a bias force therebetween;

a third crown member fixedly coupled to a first end of said outer tube member;

a plurality of third rib members, each of said plurality of third rib members having one end pivotally coupled to said third crown member and an opposing end pivotally coupled to an intermediate portion of a respective one of said plurality of second rib members;

a lower coil spring member disposed on said inner tube member between said second crown member and said flange of said intermediate tube member for applying a bias force therebetween;

lower button means disposed on said intermediate tube member and fixedly coupled to said handle member for releasable coupling with said lower portion of inner tube member, said lower button means including a first stopper member having a first hook formed on one end and extending through an opening formed in said intermediate tube member for releasable coupling with a first opening formed in said inner tube member, said first hook being disengaged from said first opening of said inner tube member responsive to a pivotal displacement of said first stopper member; and, upper button means fixedly coupled to a second end of said outer tube member for releasable coupling with said inner tube member, said upper button means including a second stopper member having a second hook formed on one end and extending through an opening formed in said outer tube member for releasable coupling with a second opening formed in said inner tube member, said second hook being disengaged from said second opening of said inner tube member responsive to a pivotal displacement of said second stopper member, said upper button means including an annular lip extending from a lower end thereof for receipt within an annular recess

* * * * *